US010051976B2

(12) United States Patent
Smith

(10) Patent No.: US 10,051,976 B2
(45) Date of Patent: Aug. 21, 2018

(54) CUTLERY DISPENSER

(71) Applicant: Jade Group International LLC, West Bend, WI (US)

(72) Inventor: Patrick J. Smith, West Bend, WI (US)

(73) Assignee: JADE GROUP INTERNATIONAL LLC, West Bend, WI (US)

( * ) Notice: Subject to any disclaimer, the term of this patent is extended or adjusted under 35 U.S.C. 154(b) by 13 days.

(21) Appl. No.: 15/701,526

(22) Filed: Sep. 12, 2017

(65) Prior Publication Data

US 2018/0000261 A1 Jan. 4, 2018

Related U.S. Application Data

(63) Continuation of application No. PCT/US2017/040466, filed on Jun. 30, 2017.

(60) Provisional application No. 62/357,034, filed on Jun. 30, 2016.

(51) Int. Cl.

| | |
|---|---|
| ***A47F 1/10*** | (2006.01) |
| ***B65D 83/08*** | (2006.01) |
| ***B65D 83/22*** | (2006.01) |

(52) U.S. Cl.

CPC ..... *A47F 1/10* (2013.01); *B65D 83/0858* (2013.01); *B65D 83/0876* (2013.01); *B65D 83/222* (2013.01); *A47F 2001/103* (2013.01); *B65D 2583/005* (2013.01)

(58) Field of Classification Search

CPC ... A61J 7/0076; B60P 3/0257; B60P 30/0207; G06F 19/3462; G06Q 30/0207; G06Q 30/0266

USPC ..... 221/265, 186, 188, 189, 263, 264; 700/242

See application file for complete search history.

(56) References Cited

U.S. PATENT DOCUMENTS

| | | | | |
|---|---|---|---|---|
| 4,134,519 | A | 1/1979 | Barnett | |
| 5,899,356 | A | 5/1999 | Huisman | |
| 6,250,498 | B1 | 6/2001 | Lovejoy | |
| 6,336,568 | B1 * | 1/2002 | Tucker | A47F 1/10 221/131 |
| 6,832,694 | B2 | 12/2004 | Goeking | |
| 7,395,946 | B2 * | 7/2008 | Yuyama | G07F 11/44 221/186 |

(Continued)

FOREIGN PATENT DOCUMENTS

WO PCTUS2017040466 6/2017

OTHER PUBLICATIONS

PCT/US2017/040466 Jun. 9, 2017 International Search Report—Patent Cooperation Treaty International Searching Authority's "Notification of Transmittal of The International Search Report and The Written Opinion of The International Searching Authority, or The Declaration".

*Primary Examiner* — Timothy R Waggoner
*Assistant Examiner* — Ayodeji T Ojofeiitimi
(74) *Attorney, Agent, or Firm* — Shane V. Cortesi

(57) ABSTRACT

A plastic cutlery dispenser having a base and a cartridge is described. The cartridge may be slideable relative to the base. In some embodiments, the base has a base dispensing mechanism and the cartridge has a cartridge dispensing mechanism configured to mate with the base dispensing mechanism. In some embodiments, when the base and cartridge dispensing mechanisms mate, the cutlery dispenser is configured to dispense cutlery located within the cartridge one piece of cutlery at a time.

24 Claims, 16 Drawing Sheets

(56) References Cited

U.S. PATENT DOCUMENTS

| | | | | |
|---|---|---|---|---|
| 7,661,553 | B2 * | 2/2010 | Zeiron | A47K 10/427 221/305 |
| 8,070,013 | B2 | 12/2011 | Reinsel | |
| 8,210,364 | B2 | 7/2012 | Smith | |
| 8,272,533 | B1 | 9/2012 | D'Amelia | |
| 8,297,473 | B2 | 10/2012 | Smith | |
| 8,360,273 | B2 * | 1/2013 | Reinsel | A47F 1/10 211/49.1 |
| 8,701,932 | B2 | 4/2014 | Reinsel | |
| 9,049,948 | B2 | 6/2015 | Jongen | |
| 9,226,598 | B1 | 1/2016 | Knope | |
| 9,237,815 | B2 | 1/2016 | Smith | |
| 9,295,344 | B2 | 3/2016 | Reinsel | |
| 9,345,340 | B2 | 5/2016 | Walters | |
| 9,439,518 | B2 | 9/2016 | Oakes | |
| 9,560,920 | B2 | 2/2017 | Oakes | |
| 9,693,640 | B2 | 7/2017 | Oakes | |
| 9,700,153 | B2 | 7/2017 | Snyder | |
| 2005/0082307 | A1 | 4/2005 | Tucker | |
| 2007/0108141 | A1 | 5/2007 | Smith | |
| 2008/0128445 | A1 | 6/2008 | Huang | |
| 2011/0226797 | A1 | 9/2011 | Reinsel | |
| 2012/0145734 | A1 | 6/2012 | Walters | |
| 2013/0193157 | A1 | 8/2013 | Jongen | |
| 2015/0028046 | A1 | 1/2015 | Oakes | |

* cited by examiner

CUTLERY DISPENSER

RELATED APPLICATIONS

This patent application is a continuation of International Patent Application No. PCT/US2017/040466, filed Jun. 30, 2017 and entitled "CUTLERY DISPENSER", which claims priority under 35 USC 119 to U.S. Application Ser. No. 62/357,034 entitled CUTLERY DISPENSER, filed Jun. 30, 2016, the contents of both of which are incorporated herein by reference in their entirety.

TECHNICAL FIELD

The present disclosure relates to plastic cutlery dispensers.

BACKGROUND OF THE INVENTION

Dispensers of plastic cutlery pieces (e.g., knives, spoons, forks and sporks) are well known in the art. U.S. Pat. No. 6,336,568 to Tucker, the entire contents of which are incorporated herein by reference, relates to a cartridge-type dispenser that dispenses cutlery pieces one at a time upon hand operation of an externally accessible utensil delivery controller. The dispenser includes a housing having at least one interior compartment in communication with an exit opening. At least partially accommodateable within the interior compartment is a stack of cutlery within a cartridge capable of universally accommodating knives or forks or spoons and provided with a portal through which a single piece of cutlery can pass and wherein a dispensable piece of cutlery is situated. The portal is situated in a pathway aligned with the exit opening. Finally, the utensil delivery controller is an externally accessible hand operable ejector engageable with the cutlery and situated for ejecting the cutlery from the portal of the cartridge and thereafter through the pathway to the exit opening for ultimate user retrieval.

Other types of dispensers include dispensers in which the cutlery is loaded in the housing such as U.S. Pat. No. 8,210,364 to Smith, the entire contents of which are incorporated herein by reference. In U.S. Pat. No. 8,210,364 the dispenser generally includes a housing comprising: (a) an actuator, the actuator generally facing in a direction associated with a side of the housing; (b) an opening for loading disposable cutlery; (c) a dispensing chute through which the cutlery passes prior to ejection from the housing; and (d) at least one rocking cam comprising a displacement surface and having a first position and a second position, wherein upon activation of the actuator, the rocking cam moves from the first position to the second position and the displacement surface contacts at least one piece of cutlery, moving the at least one piece of cutlery in a generally lateral direction and toward the dispensing chute, wherein the generally lateral direction is towards the side of the housing in which the actuator is generally facing.

In dispensers such as U.S. Pat. No. 8,210,364, the cutlery must be reloaded from the top of the housing, which is problematic, especially if the cutlery dispenser is mounted to a wall above eye level. The problem with traditional cartridge dispensers, such as the dispenser taught in U.S. Pat. No. 6,336,568 to Tucker, is that the cartridges are expensive.

Thus, there is a continuing need for new cutlery dispensers.

BRIEF SUMMARY

The present disclosure provides a cutlery dispenser as described herein. In some embodiments, the cutlery dispenser comprises at least two parts: 1) a base; and 2) a cartridge comprising a chamber for holding cutlery. The cartridge may move relative to the base. For example, the cartridge may slide into the base. Optionally, the cartridge has a lock out to prevent the dispensing of cutlery when the cartridge is not in a certain position relative to the base.

More particularly the present disclosure provides a cutlery dispenser that may comprise some or all of the following features: a base comprising a base bottom configured to rest on a surface, a base top opposite the base bottom, and a base height extending from the base bottom to the base top; a cartridge attached to the base and comprising a cartridge bottom, a cartridge top, a cartridge height extending from the cartridge bottom to the cartridge top, and a chamber; a stack of cutlery pieces located in the cartridge chamber, each cutlery piece having a eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height; a system dispensing mechanism configured to move between a resting position in which the cutlery stack is stationary within the cartridge chamber to a dispensing position in which the system dispensing mechanism ejects at least a portion of a piece of cutlery out of the cartridge chamber, the system dispensing mechanism comprising a base dispensing mechanism forming a portion of the base and a cartridge dispensing mechanism located in the cartridge chamber, the base dispensing mechanism removably engaged with the cartridge dispensing mechanism; and an actuator configured to move the system dispensing mechanism from the resting position to the dispensing position.

Optionally, the actuator extends from the cartridge dispensing mechanism. Optionally, the cutlery dispenser further includes a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position, wherein engaging the base dispensing mechanism with the cartridge dispensing mechanism is configured to move the dispenser lock from the dispenser locked position to the dispenser unlocked position and further wherein disengaging the base dispensing mechanism from the cartridge dispensing mechanism is configured to move the dispenser lock from the dispenser unlocked position to the dispenser locked position. Optionally, the cartridge chamber comprises a wall comprising a wall tab and the cartridge dispensing mechanism further comprises a cartridge dispensing mechanism tab, the wall tab and the cartridge dispensing mechanism tab forming the lock and further wherein the wall tab and the cartridge dispensing mechanism tab are engaged when the dispenser lock is in the dispenser locked position and further wherein the wall tab and the cartridge dispensing mechanism tab are disengaged when the dispenser lock is in the dispenser unlocked position. Optionally, the cartridge chamber comprises a spring configured to press the cartridge dispensing mechanism tab against the wall tab when the cartridge dispensing mechanism is not engaged with the base dispensing mechanism. Optionally, the system dispensing mechanism comprises a base cam shaft attached to the base and a cartridge cam shaft attached to the cartridge, the base cam shaft forming the base dispensing mechanism and the cartridge cam shaft forming the cartridge dispensing mechanism. Optionally, the system dispensing mechanism comprises a fastener configured to removably attach the base cam shaft to the cartridge cam shaft. Optionally, the base comprises a base spring comprising a first end attached to the base and a second end attached to the base dispensing mechanism. Optionally, the base comprises a track and the cartridge comprises a flange configured to mate with the track and further wherein the cartridge is configured to slide along the track. Optionally, the cutlery dispenser further comprises a base front, a base back, and a base length extending from the base front to the base back, and wherein the base further comprises two opposing base grooves extending along the base length, the two opposing base grooves forming the track. Optionally, the base bottom is generally rectangular in shape, wherein the base comprises a first side wall comprising one of the base grooves and the base comprises a second side wall opposite the first side wall and comprising the other base groove. Optionally, the first side wall and the second side wall border the base upper surface. Optionally, the base further comprises a stop. Optionally, the cartridge chamber comprises at least one guide column, the guide column having a guide column height parallel to the stack height. Optionally, the system dispensing mechanism dispenses the handle of the bottom cutlery piece to a user before the eating portion. Optionally, the system dispensing mechanism and the actuator pivot in the same direction and generally perpendicular to the cartridge height when the system dispensing mechanism moves from the resting position to the dispensing position. Optionally, the cartridge dispensing mechanism, in the resting position, comprises a top surface, the bottom cutlery piece resting on the top surface. Optionally, the cartridge further comprises a ramp configured to receive the piece of cutlery from the chute and move the piece of cutlery toward a user. Optionally, the cartridge is generally rectangular in shape and comprises a cartridge left side, a cartridge right side, a cartridge width extending from the cartridge left side to the cartridge right side, a cartridge front side, a cartridge rear side, a cartridge length extending from the cartridge front side to the cartridge rear side, wherein the base is generally rectangular in shape and comprises a base left side, a base right side, a base width extending from the base left side to the base right side, a base front side, a base rear side, a base length extending from the base front side to the base rear and further wherein the system dispensing mechanism is configured to move the bottom piece of cutlery into a chute in a direction generally perpendicular to the cutlery piece length and further wherein the cartridge further comprises a ramp configured to receive the piece of cutlery from the chute and move the piece of cutlery forwardly toward a user. Optionally, the ramp further comprises a top and a bottom and further wherein the handle tip of the cutlery is configured to be the first part to reach the ramp bottom. Optionally, the base comprises a base upper surface and further wherein the base upper surface and the cartridge bottom are generally flat. The base upper surface may be opposite the base bottom and may face vertically upward.

In still further embodiments, the present disclosure provides a cutlery dispenser that includes some or all of the following features: a base comprising a base bottom configured to rest on a surface, a base top opposite the base bottom, a base height extending from the base bottom to the base top, and a base upper surface; a cartridge comprising a cartridge bottom, a cartridge top, a cartridge height extending from the cartridge bottom to the cartridge top, and a chamber; a stack of cutlery pieces located in the cartridge chamber, each cutlery piece having a eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height; and a system dispensing mechanism configured to move between a resting position in which the cutlery stack is stationary within the cartridge chamber to a dispensing position in which the system dispensing mechanism ejects at least a portion of a piece of cutlery out of the cartridge chamber, wherein the cartridge comprises a cartridge locked position in which the cartridge is fixed to the base and a cartridge unlocked position in which the cartridge is configured to disengage from the base and in which the cartridge bottom is configured to confront and slide along the base upper surface.

Optionally, the base upper surface and the cartridge bottom are generally flat. Optionally, the base further comprises a track and wherein the cartridge further comprises a flange configured to mate with the track and further wherein the flange is configured to slide along the track in the cartridge unlocked position. Optionally, the track is adjacent to the base upper surface and the flange is adjacent to the cartridge bottom. Optionally, the cutlery dispenser further comprises a base front, a base back, and a base length extending from the base front to the base back, and wherein the base further comprises two opposing base grooves extending along the base length, the two opposing base grooves forming the track. Optionally, the base bottom is generally rectangular in shape, wherein the base comprises a first side wall comprising one of the base grooves and the base comprises a second side wall opposite the first side wall and comprising the other base groove. Optionally, the first side wall and the second side wall border the base upper surface. Optionally, the cutlery dispenser further comprises a removable stop, the removable stop configured to prevent the flange from sliding along the track length. Optionally, the removable stop is configured to maintain the cartridge in the cartridge locked position. Optionally, the base bottom is generally flat. Optionally, the cutlery dispenser further comprises an actuator configured to move the system dispensing mechanism from the resting position to the dispensing position. Optionally, the cutlery dispenser further comprises a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position. Optionally, the dispenser lock is in the dispenser unlocked position when the cartridge is in the cartridge locked position and wherein the dispenser is in the dispenser locked position when the cartridge is in the cartridge unlocked position. Optionally, the system dispensing mechanism comprises a base dispensing mechanism forming a portion of the base and a cartridge dispensing mechanism located in the cartridge chamber, the base dispensing mechanism removably engaged with the cartridge dispensing mechanism when the cartridge is in the cartridge locked position. Optionally, engaging the base dispensing mechanism with the cartridge dispensing mechanism is configured to move the dispenser lock from the dispenser locked position to the dispenser unlocked position and further wherein disengaging the base dispensing mechanism from the cartridge dispensing mechanism is configured to move the dispenser lock from the dispenser unlocked position to the dispenser locked position. Optionally, the cartridge chamber comprises a wall comprising a wall tab and the cartridge dispensing mechanism further comprises a cartridge dispensing mechanism tab, the wall tab and the cartridge dispensing mechanism tab forming the dispenser lock and further wherein the wall tab and the cartridge dispensing mechanism tab are engaged when the dispenser lock is in the dispenser locked position and further wherein the wall tab and the cartridge dispensing mechanism tab are disengaged when the dispenser lock is in the dispenser unlocked position. Optionally, the cartridge chamber comprises a spring configured to press the cartridge dispensing mechanism tab against the wall tab when the cartridge dispensing mechanism is not engaged with the base dispensing mechanism. Optionally, the system dispensing mechanism comprises a base cam shaft attached to the base and a cartridge cam shaft attached to the cartridge, the base cam shaft forming the base dispensing mechanism and the cartridge cam shaft forming the cartridge dispensing mechanism. Optionally, the system dispensing mechanism comprises a fastener configured to removably attach the base cam shaft to the cartridge cam shaft. Optionally, the base comprises a base spring comprising a first end attached to the base and a second end attached to the base dispensing mechanism.

In still further embodiments, the present disclosure provides a cutlery dispenser that includes some or all of the following features a base comprising a base bottom configured to rest on a surface, a base top opposite the base bottom, and a base height extending from the base bottom to the base top; a cartridge comprising a cartridge bottom, a cartridge top, a cartridge height extending from the cartridge bottom to the cartridge top, and a chamber; a stack of cutlery pieces located in the cartridge chamber, each cutlery piece having a eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height; and a system dispensing mechanism configured to move between a resting position in which the cutlery stack is stationary within the cartridge chamber to a dispensing position in which the system dispensing mechanism ejects at least a portion of a piece of cutlery out of the cartridge chamber, wherein the cartridge is configured to slide relative to the base from a first position to a second position.

Optionally, the cutlery dispenser further includes a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position. In addition, the cutlery dispenser may include one or more of the features of the prior embodiments.

BRIEF DESCRIPTION OF THE DRAWINGS

in FIG. 1, the system dispensing mechanism is in the resting position, the cartridge is in the cartridge locked position, and the dispenser lock is in the dispenser unlocked position.

in FIG. 2, the system dispensing mechanism is in the resting position, the cartridge is in the cartridge locked position, and the dispenser lock is in the dispenser unlocked position.

in FIG. 3, the system dispensing mechanism is in the resting position, the cartridge is in the cartridge locked position, and the dispenser lock is in the dispenser unlocked position.

in FIG. 4, the system dispensing mechanism is in the resting position, the cartridge is in the cartridge locked position, and the dispenser lock is in the dispenser unlocked position.

in FIG. 5, the system dispensing mechanism is in the resting position, the cartridge is in the cartridge locked position, and the dispenser lock is in the dispenser unlocked position.

in FIG. 6, a portion of the cartridge is hidden to better show the cartridge dispensing mechanism; in FIG. 6, the system dispensing mechanism is in the resting position, the cartridge is in the cartridge locked position, and the dispenser lock is in the dispenser unlocked position.

in FIG. 7, a portion of the cartridge is hidden to better show the cartridge dispensing mechanism; in FIG. 7, the system dispensing mechanism is in the resting position, and the dispenser lock is in the dispenser unlocked position.

in FIG. 8, a piece of cutlery is located on the top of the cartridge dispensing mechanism and the system dispensing mechanism is in the resting position.

in FIG. 9, a portion of the cartridge is hidden to better show the cartridge dispensing mechanism; in FIG. 9, the system dispensing mechanism is in the resting position, the cartridge is in the cartridge locked position, and the dispenser lock is in the dispenser unlocked position.

in FIG. 10, the system dispensing mechanism is in the resting position, the cartridge is in the cartridge unlocked position, and the dispenser lock is in the dispenser locked position.

in FIG. 11, the system dispensing mechanism is in the resting position, the cartridge is in the cartridge unlocked position, and the dispenser lock is in the dispenser locked position.

in FIG. 12, the top of the base is removed to better show the base dispensing mechanism; in FIG. 12, the system dispensing mechanism is in the resting position, the cartridge is in the cartridge unlocked position, and the dispenser lock is in the dispenser locked position.

in FIG. 13, the system dispensing mechanism is in the resting position, the cartridge is in the cartridge locked position, and the dispenser lock is in the dispenser unlocked position.

in FIG. 14, the system dispensing mechanism is in the resting position, the cartridge is in the cartridge locked position, and the dispenser lock is in the dispenser unlocked position.

in FIG. 15, the system dispensing mechanism is in the resting position, the cartridge is in the cartridge locked position, and the dispenser lock is in the dispenser unlocked position.

in FIG. 16, the base dispensing mechanism and the cartridge dispensing mechanism are not engaged, which means that the wall tab is engaged with the cartridge dispensing tab, which prevents the cam of the cartridge dispensing mechanism from turning (i.e., the dispenser lock is in the dispenser locked position).

in FIG. 17, the base dispensing mechanism and the cartridge dispensing mechanism are engaged, which means that the wall tab is not engaged with the cartridge dispensing tab, which means that the cartridge dispensing mechanism is activated and able to turn (i.e., the dispenser lock is in the dispenser unlocked position); in FIG. 17, the stop is not in place so that the cartridge is in the cartridge unlocked position.

in FIG. 18, the base dispensing mechanism and the cartridge dispensing mechanism are engaged, which means that the wall tab is not engaged with the cartridge dispensing tab, which means that the cartridge dispensing mechanism is activated and able to turn (i.e., the dispenser lock is in the dispenser unlocked position); in FIG. 18, the stop is in place so that the cartridge is in the cartridge locked position.

in FIG. 19, the system dispensing mechanism is in the resting position, the cartridge is in the cartridge locked position, and the dispenser lock is in the dispenser unlocked position.

in FIG. 20, the system dispensing mechanism has moved from the resting position to the dispensing position, and the cartridge is in the cartridge locked position, and the dispenser lock is in the dispenser unlocked position.

in FIG. 21, the system dispensing mechanism is in the dispensing position, and the cartridge is in the cartridge locked position, and the dispenser lock is in the dispenser unlocked position.

in FIG. 22, the system dispensing mechanism has returned to the resting position, and the cartridge is in the cartridge locked position, and the dispenser lock is in the dispenser unlocked position.

DETAILED DESCRIPTION

Figure 1:
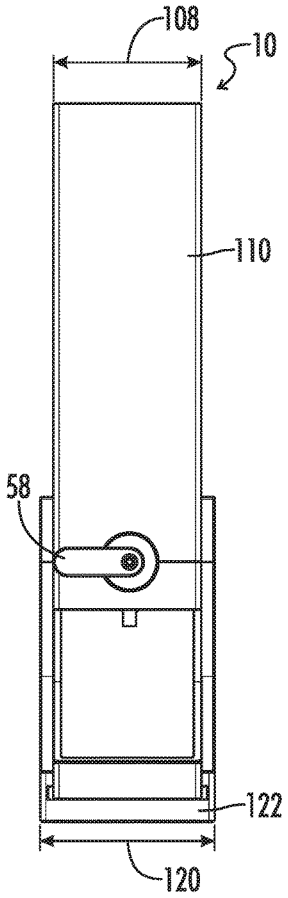
FIG. 1 illustrates a front elevation view of one embodiment of a cutlery dispenser of the present invention.
Figure 2:
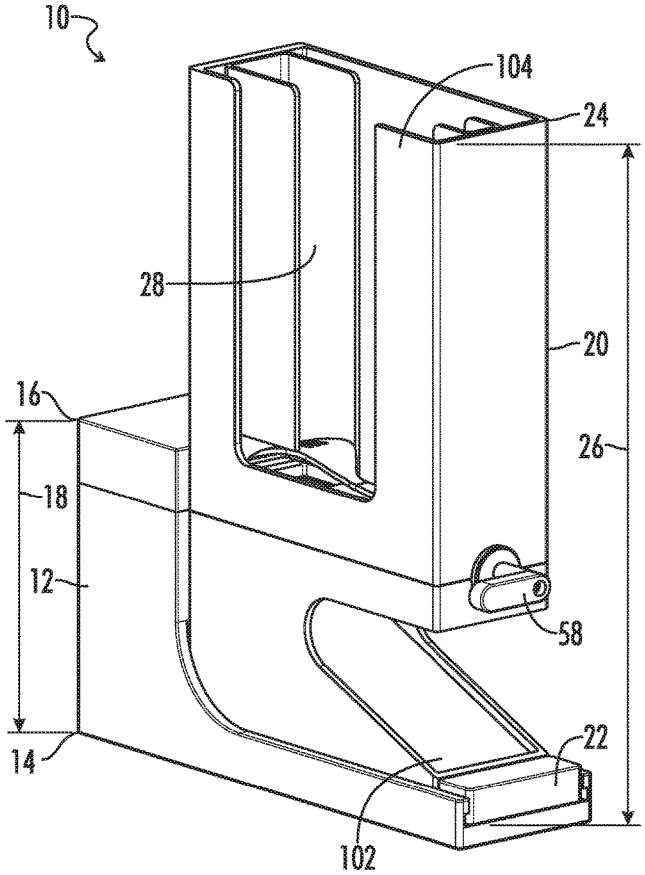
FIG. 2 illustrates a left side perspective view of the cutlery dispenser of FIG. 1.
Figure 3:
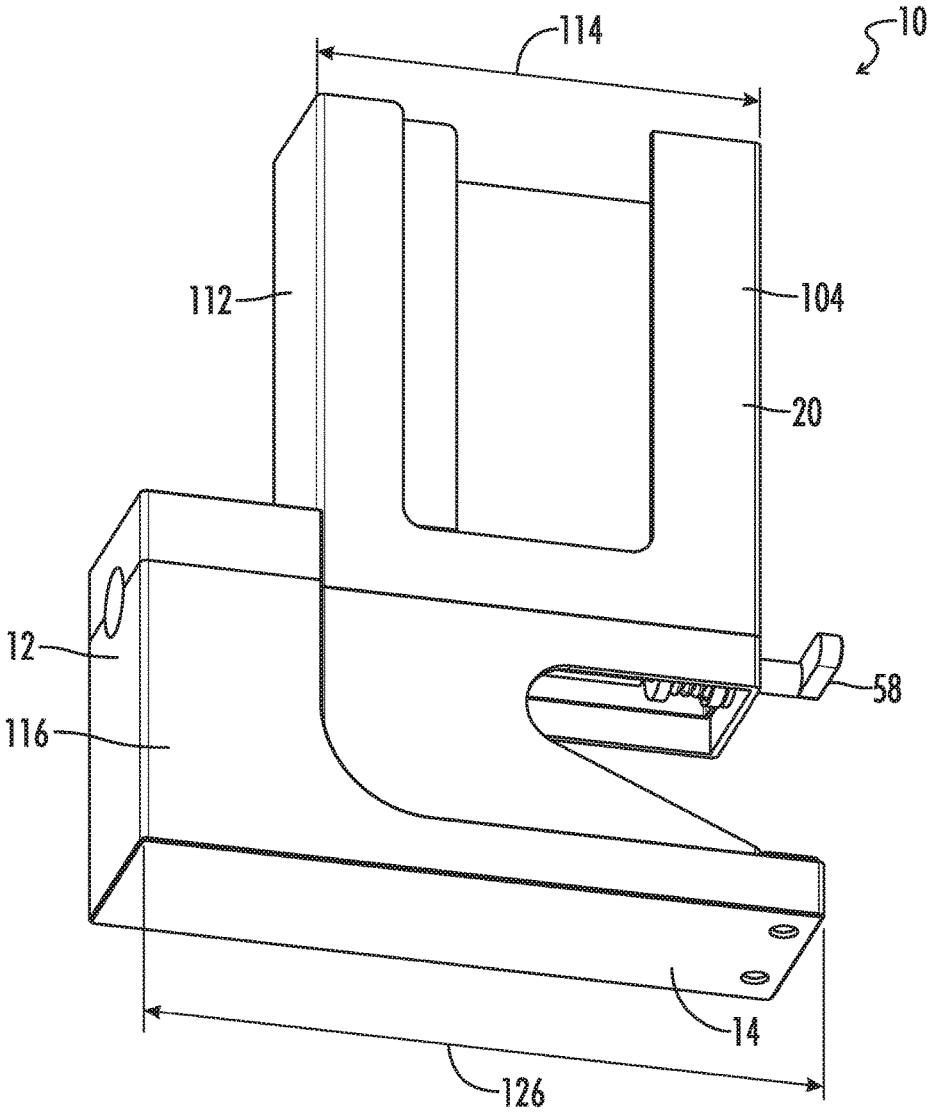
FIG. 3 illustrates a bottom perspective view of the cutlery dispenser of FIG. 1.
Figure 4:
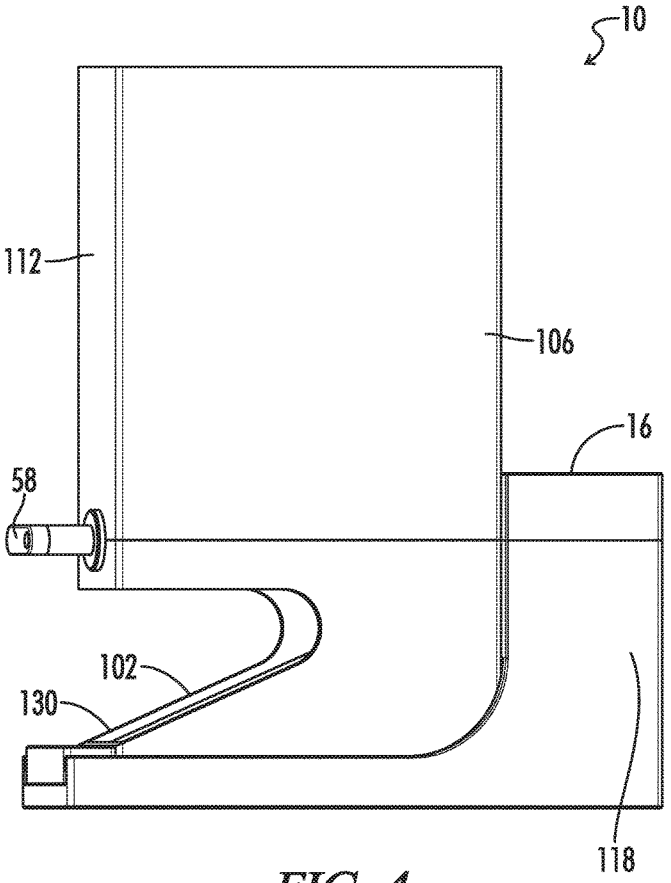
FIG. 4 illustrates a right side elevation view of the cutlery dispenser of FIG. 1.
Figure 5:
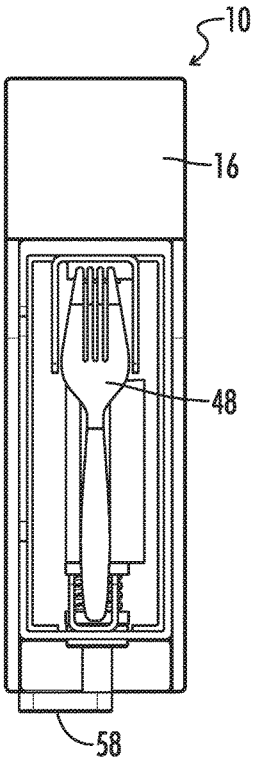
FIG. 5 illustrates a top plan view of the cutlery dispenser of FIG. 1.
Figure 6:
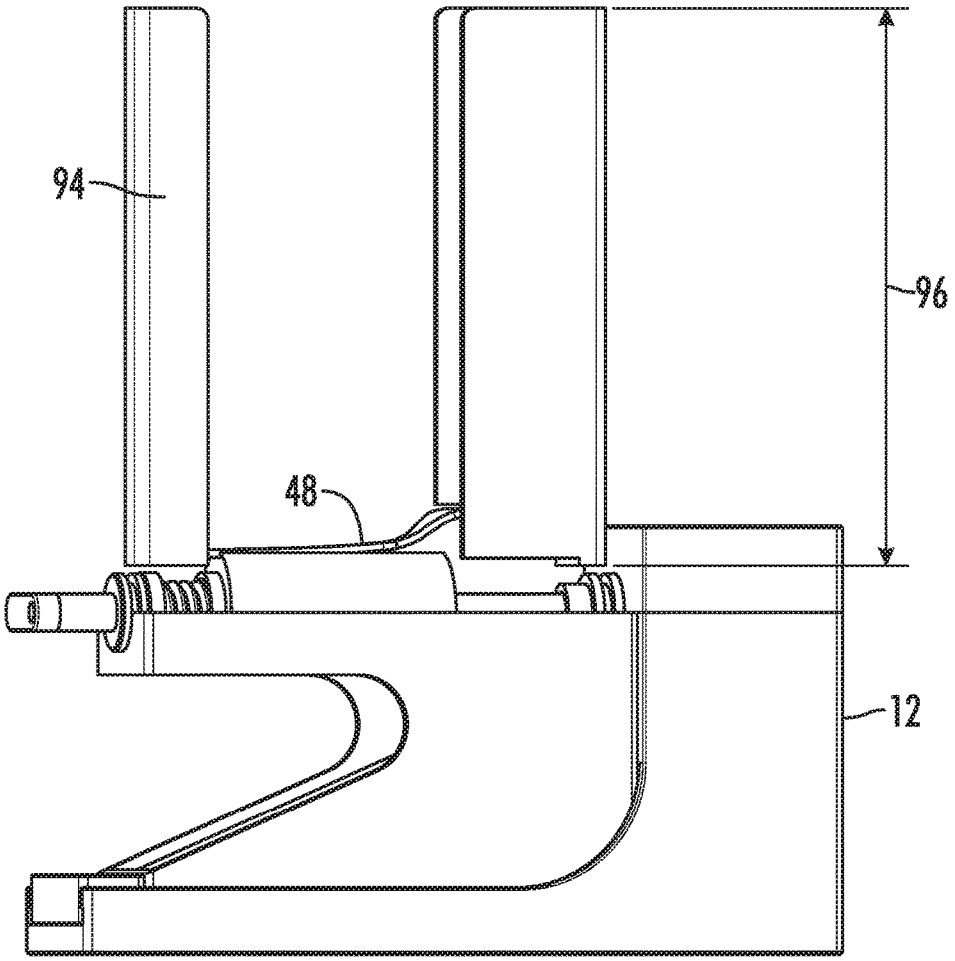
FIG. 6 illustrates a right side elevation view of the cutlery dispenser of FIG. 1.
Figure 7:
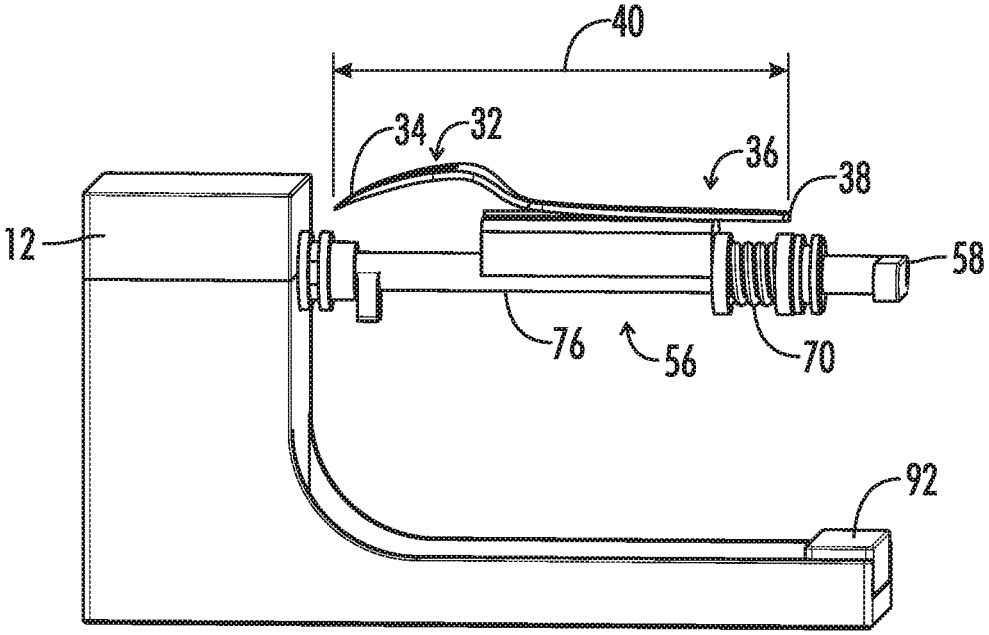
FIG. 7 illustrates a left side elevation view of the cutlery dispenser of FIG. 1.
Figure 8:
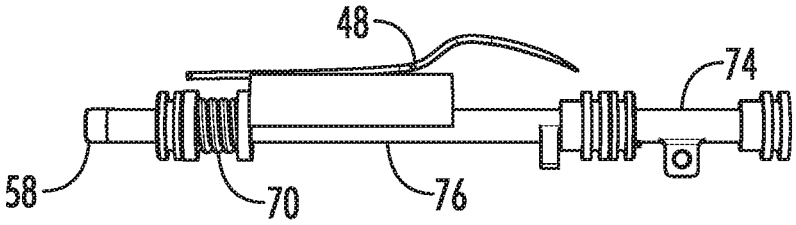
FIG. 8 illustrates a right side elevation view of the system dispensing mechanism and actuator.
Figure 9:
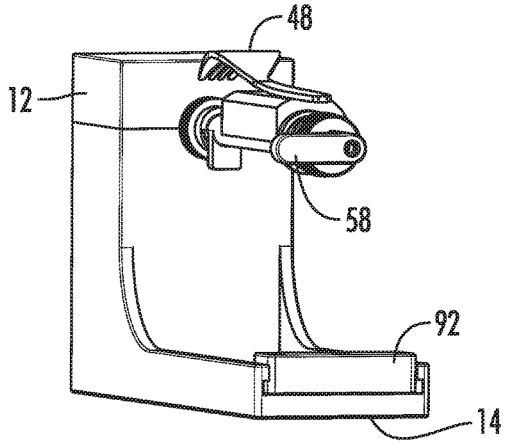
FIG. 9 illustrates a front perspective view of the cutlery dispenser of FIG. 1.

Referring to FIGS. 1-22, the present disclosure provides a cutlery dispenser generally designated by the numeral 10. In the drawings, not all reference numbers are included in each drawing for the sake of clarity. It will also be understood that FIGS. 1-22 are CAD drawings, drawn to scale. However, other dimensions are possible.

Referring to FIGS. 1-22, the present disclosure provides a cutlery dispenser 10 comprising a base 12 comprising a base bottom 14 configured to rest on a surface (e.g., on the ground or on a countertop), a base top 16 opposite the base bottom 14, and a base height 18 extending from the base bottom 14 to the base top 16. The cutlery dispenser 10 further comprises a cartridge 20 attached to the base 12 and comprising a cartridge bottom 22, a cartridge top 24, a cartridge height 26 extending from the cartridge bottom 22 to the cartridge top 24, and a chamber 28 located in the interior of the cartridge 20. The cutlery dispenser 10 further includes a stack of cutlery pieces 30 (e.g., a plastic fork, knife, spoon or spork) located in the cartridge chamber 28, each cutlery piece 30 having a eating portion 32 comprising an eating portion tip 34, a handle 36 comprising a handle tip 38 and a cutlery piece length 40 extending from the eating portion tip 34 to the handle tip 38, the cutlery piece length 40 generally perpendicular to the cartridge height 26, the stack of cutlery pieces 30 comprising a top 42 comprising a top cutlery piece 44, a bottom 46 comprising a bottom cutlery piece 48 and a stack height 50 extending from the top cutlery piece 44 to the bottom cutlery piece 48 and generally parallel to the cartridge height 26. (The eating portion 32 is also referred to in the art as the food contact portion of the cutlery such as the serrations of a knife, the tines of a fork, and the bowl of a spoon).

The cutlery dispenser 10 further includes a system dispensing mechanism configured to move between a resting position in which the cutlery stack 30 is stationary within the cartridge chamber 28 to a dispensing position in which the system dispensing mechanism ejects at least a portion (preferably at least the handle tip 38) of a piece of cutlery (preferably the bottom piece of cutlery 48) out of the cartridge chamber 28. The system dispensing mechanism may be comprised of a base dispensing mechanism 54 forming a portion of the base 12 (more particularly the base dispensing mechanism 54 may be at least partially located in the interior of the base) and a cartridge dispensing mechanism 56 located in the cartridge chamber 28, the base dispensing mechanism 54 removably engaged with the cartridge dispensing mechanism 56. In other words, the system dispensing mechanism of some embodiments comprises two parts: the base dispensing mechanism 54 and the cartridge dispensing mechanism 56.

Figure 16:
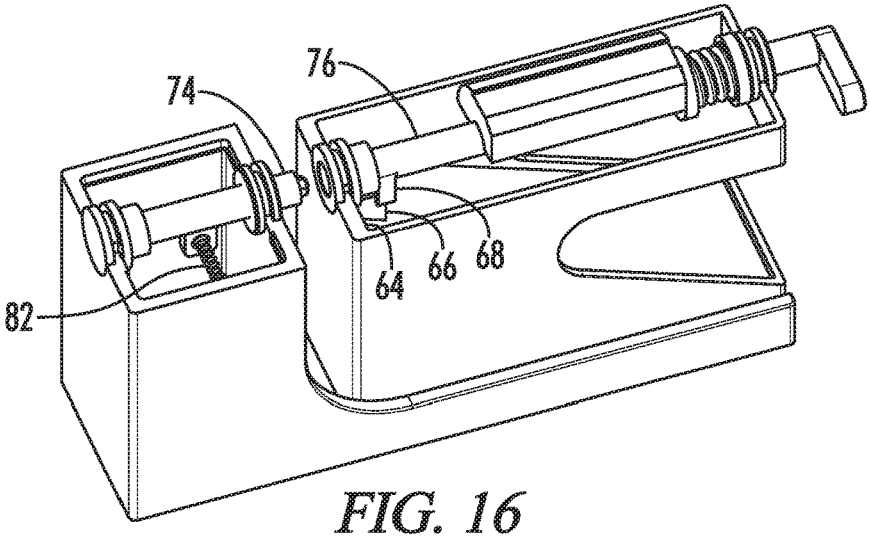
FIG. 16 illustrates a top perspective view of a portion of the base dispensing mechanism and a portion of the cartridge dispensing mechanism of the cutlery dispenser of FIG. 1.

The cutlery dispenser 10 preferably further includes an actuator 58 configured to move the system dispensing mechanism from the resting position to the dispensing position. When the base dispensing mechanism 54 is not engaged with the cartridge dispensing mechanism 56, as best seen in FIG. 16, the front portion of the base dispensing mechanism 54 may protrude from the external wall of the base 12.

Optionally, the actuator 58 extends from the cartridge dispensing mechanism 56. Optionally, the actuator 58 is external to the cartridge chamber 28, as shown in FIGS. 1-22. Optionally, the actuator 58 is a knob or other handle.

Figure 17:
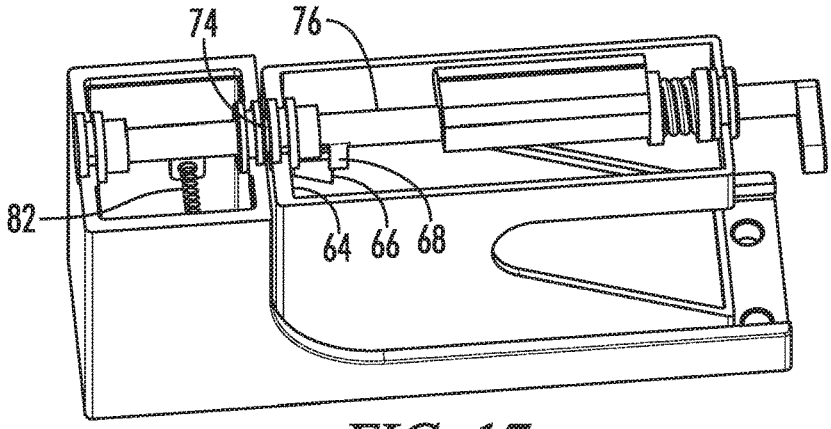
FIG. 17 illustrates a top perspective view of a portion of the base dispensing mechanism and a portion of the cartridge dispensing mechanism of the cutlery dispenser of FIG. 1.
Figure 18:
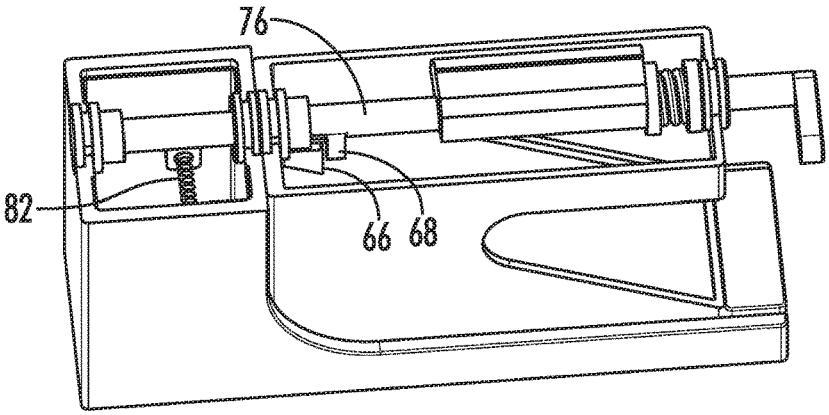
FIG. 18 illustrates a top perspective view of a portion of the base dispensing mechanism and a portion of the cartridge dispensing mechanism of the cutlery dispenser of FIG. 1.

Optionally, the cutlery dispenser 10 includes a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position. Optionally, engaging the base dispensing mechanism 54 with the cartridge dispensing mechanism 56 is configured to move the dispenser lock from the dispenser locked position to the dispenser unlocked position and further wherein disengaging the base dispensing mechanism 54 from the cartridge dispensing mechanism 56 is configured to move the dispenser lock from the dispenser unlocked position to the dispenser locked position. More particularly, the cartridge chamber 28 may comprise a wall 64 comprising a wall tab 66 and the cartridge dispensing mechanism 56 further comprises a cartridge dispensing mechanism tab 68, the wall tab 66 and the cartridge dispensing mechanism tab 68 forming the aforementioned lock. Optionally, the wall tab 66 and the cartridge dispensing mechanism tab 68 are engaged when the system dispensing mechanism is in the locked position, as shown in FIG. 16, and the wall tab 66 and the cartridge dispensing mechanism tab 68 are disengaged when the system dispensing mechanism is in the unlocked position, as shown in FIGS. 17-18. More particularly, the cartridge chamber 28 may comprise a spring 70, best seen in FIGS. 7-8 and FIG. 15, configured to press the cartridge dispensing mechanism tab 68 against the wall tab 66 when the cartridge dispensing mechanism 56 is not engaged with the base dispensing mechanism 54. In other words, when the cartridge dispensing mechanism 56 is not engaged with the base mechanism 54, the wall tab 66 interferes with the cartridge dispensing mechanism tab 68 as best seen in FIG. 16, preventing the cartridge cam shaft 76 of the cartridge dispensing mechanism 56 from turning and dispensing cutlery. When the cartridge dispensing mechanism 56 is engaged with the base dispensing mechanism 54, the base dispensing mechanism 54 urges the cartridge cam shaft 76 of the cartridge dispensing mechanism 56 forwardly, overcoming the force of the spring 70, which allows the cartridge cam shaft 76 of the cartridge dispensing mechanism 56 to turn and dispense cutlery. The end result is that when the cartridge 20 needs to be re-loaded with cutlery, the operator may remove the cartridge 20 from the base 12 to add more cutlery pieces and the operator may re-attach the cartridge 20 to the base 12 without worrying about the cartridge 20 dispensing cutlery in the process because the cartridge dispensing mechanism 56 is de-activated by the interference between the wall tab 66 and the cartridge dispensing tab 68 during the re-loading process.

Figure 10:
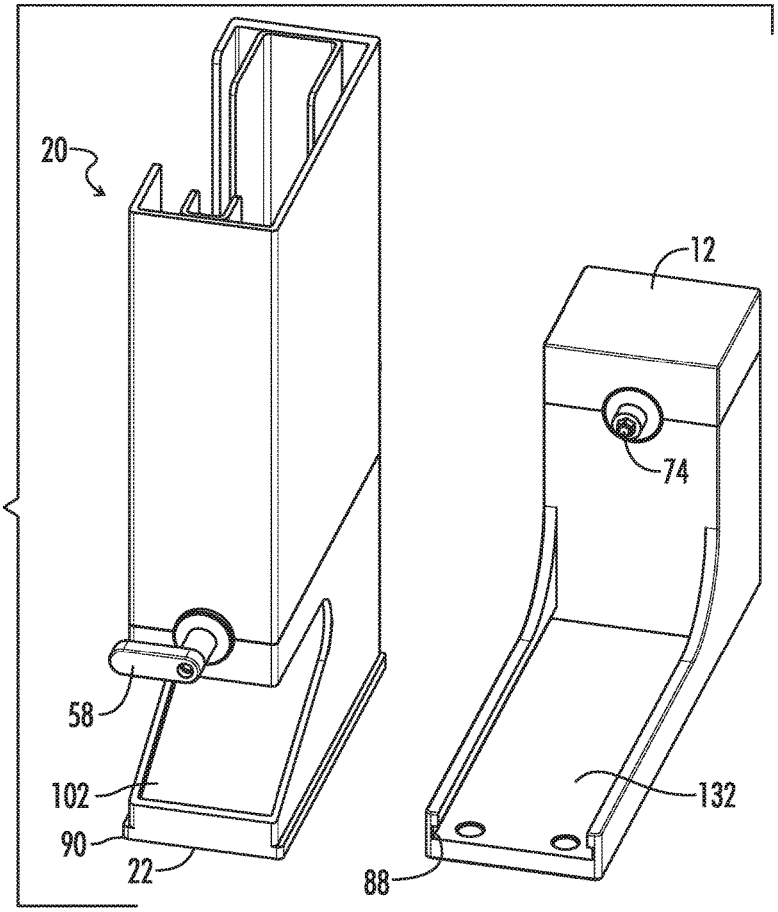
FIG. 10 illustrates a front perspective view of the cartridge and the base of the cutlery dispenser of FIG. 1.
Figure 11:
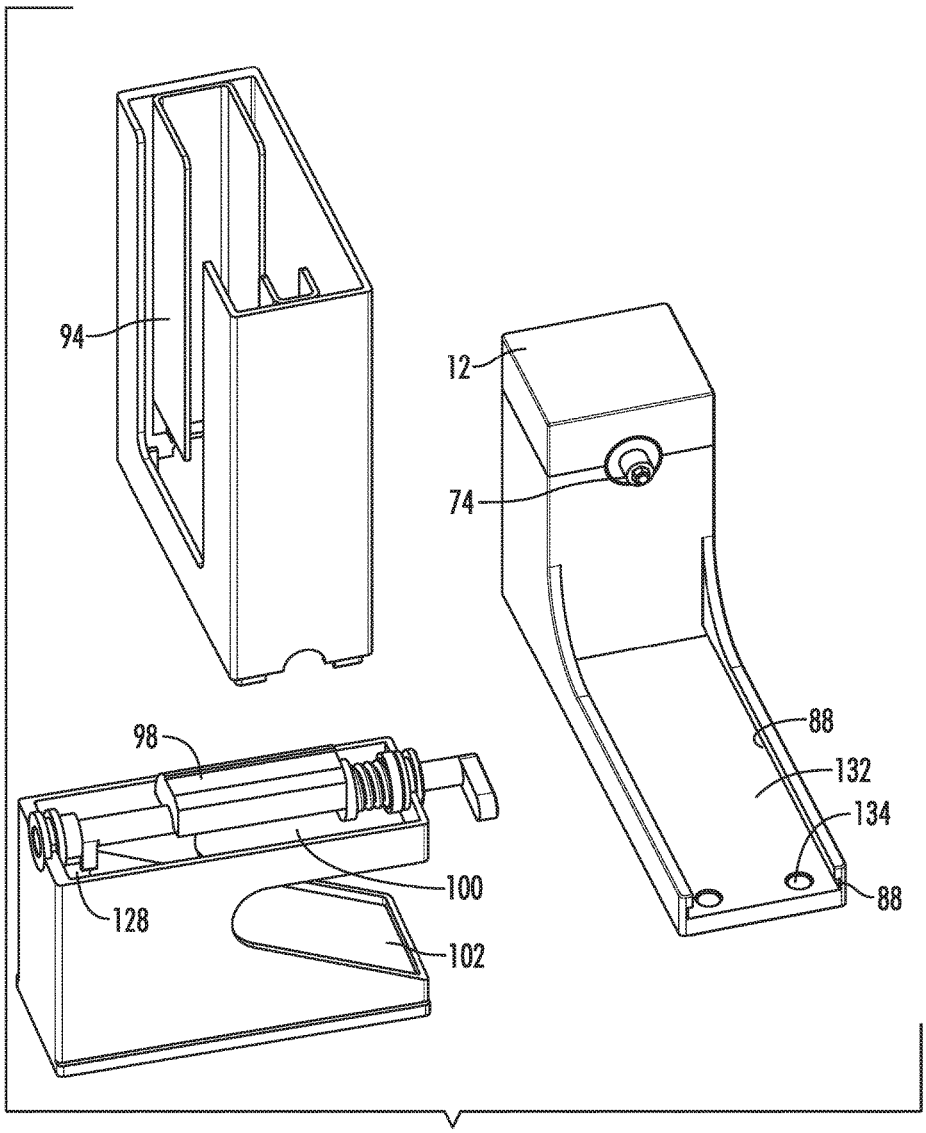
FIG. 11 illustrates a left side elevation view of a portion of the cartridge of the cutlery dispenser of FIG. 1 containing the cartridge dispensing mechanism, a front perspective view of the base of the cutlery dispenser of FIG. 1, and a rear perspective view of a portion of the cartridge of the cutlery dispenser of FIG. 1 containing the guide.
Figure 12:
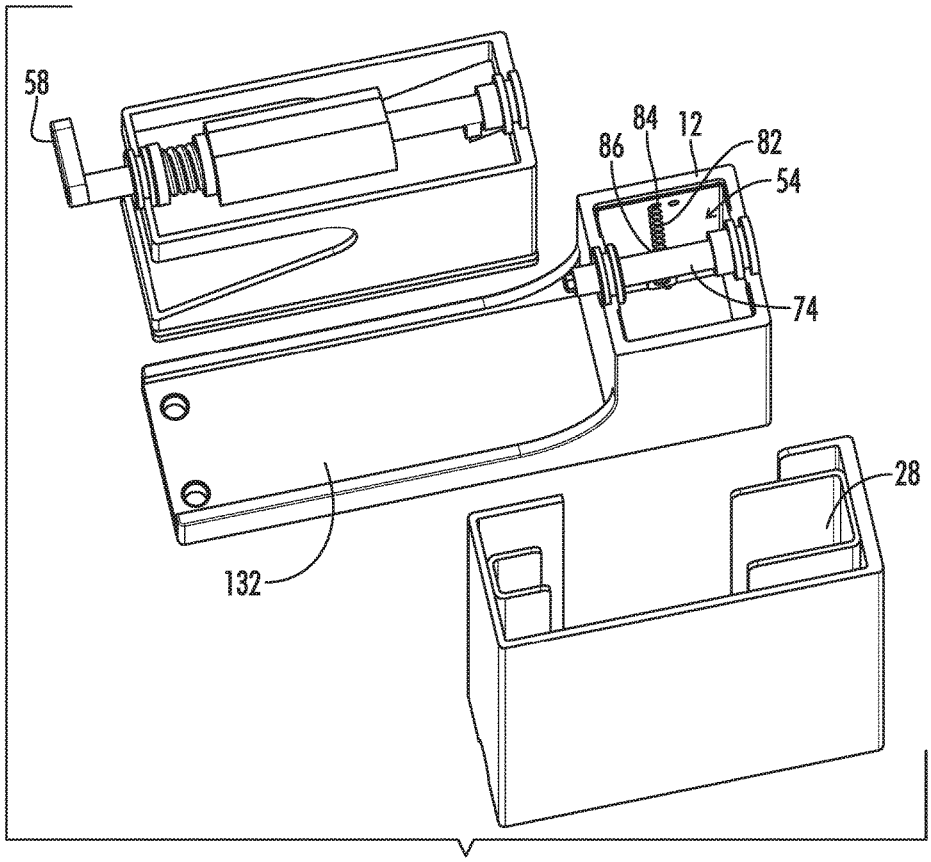
FIG. 12 illustrates a top exploded perspective views of the base, cartridge and cartridge dispensing mechanism of the cutlery dispenser of FIG. 1.
Figure 13:
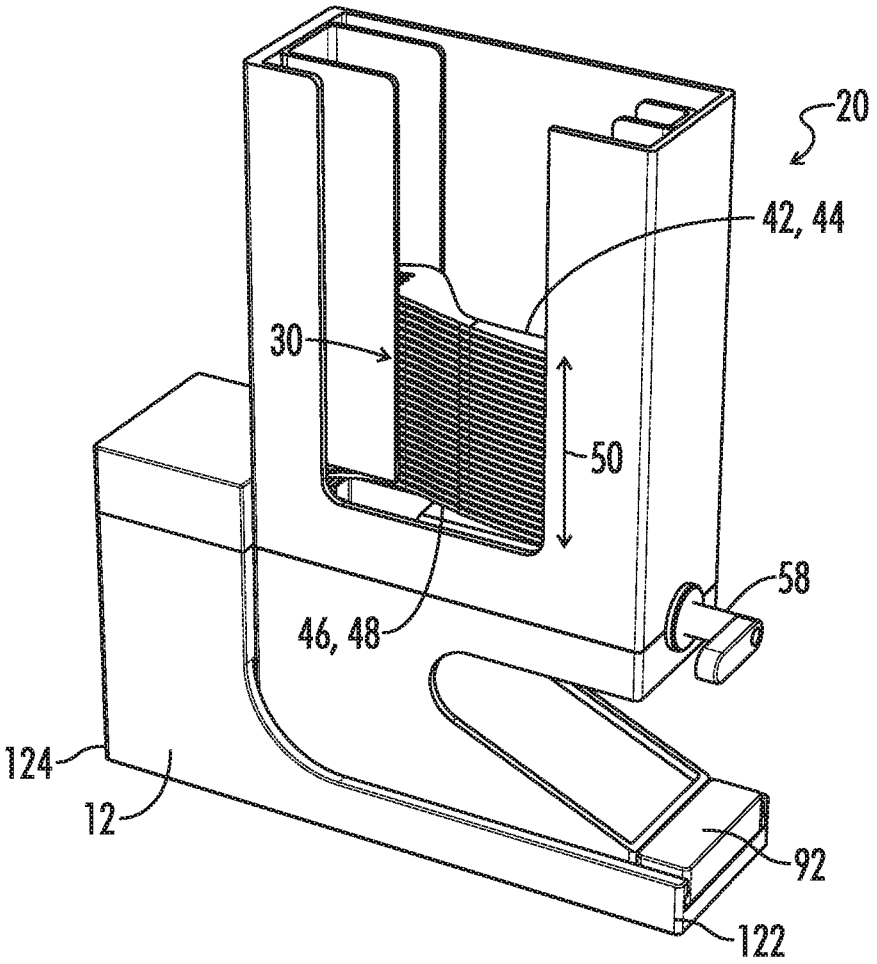
FIG. 13 illustrates a left side perspective view of the cutlery dispenser of FIG. 1.
Figure 14:
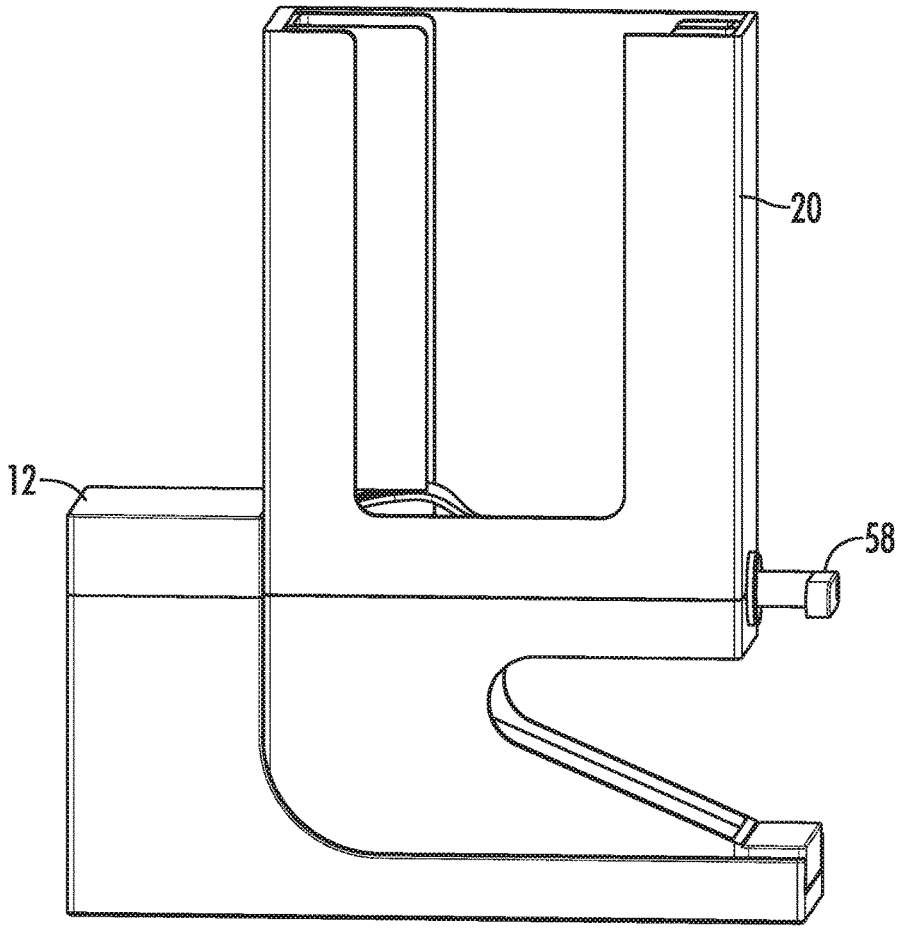
FIG. 14 illustrates a left side perspective view of the cutlery dispenser of FIG. 1.
Figure 15:
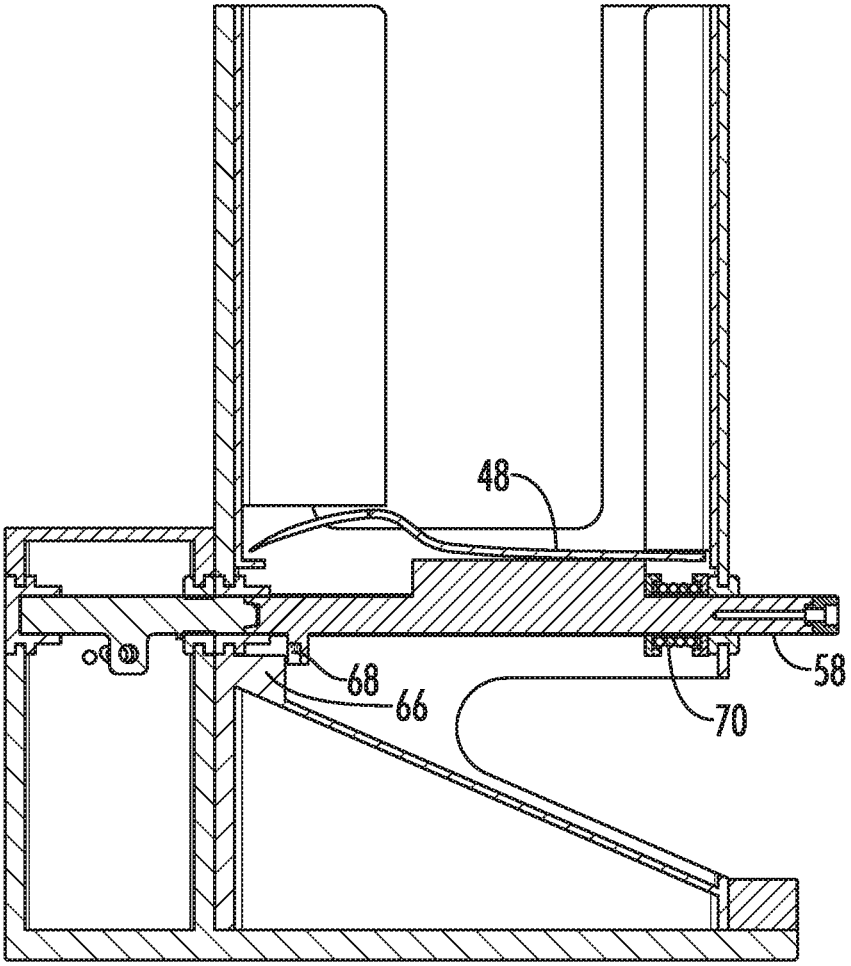
FIG. 15 illustrates a left side cross-sectional view of the cutlery dispenser of FIG. 1.

Optionally, the cartridge dispensing mechanism comprises a base cam shaft 74 attached to the base 12 and a cartridge cam shaft 76 attached to the cartridge 20, the base cam shaft 74 forming the base dispensing mechanism 54 and the cartridge cam shaft 76 forming the cartridge dispensing mechanism 56. Optionally, the system dispensing mechanism comprises a fastener configured to removably attach the base cam shaft 74 to the cartridge cam shaft 76. For example, the front of the base cam shaft 74 and the rear of the cartridge cam shaft 76 may contain mating hexagonal surfaces, as shown in FIG. 15 for example. For example, FIGS. 10-12 show hexagonal surfaces on the front of the base cam shaft 74.

Figure 22:
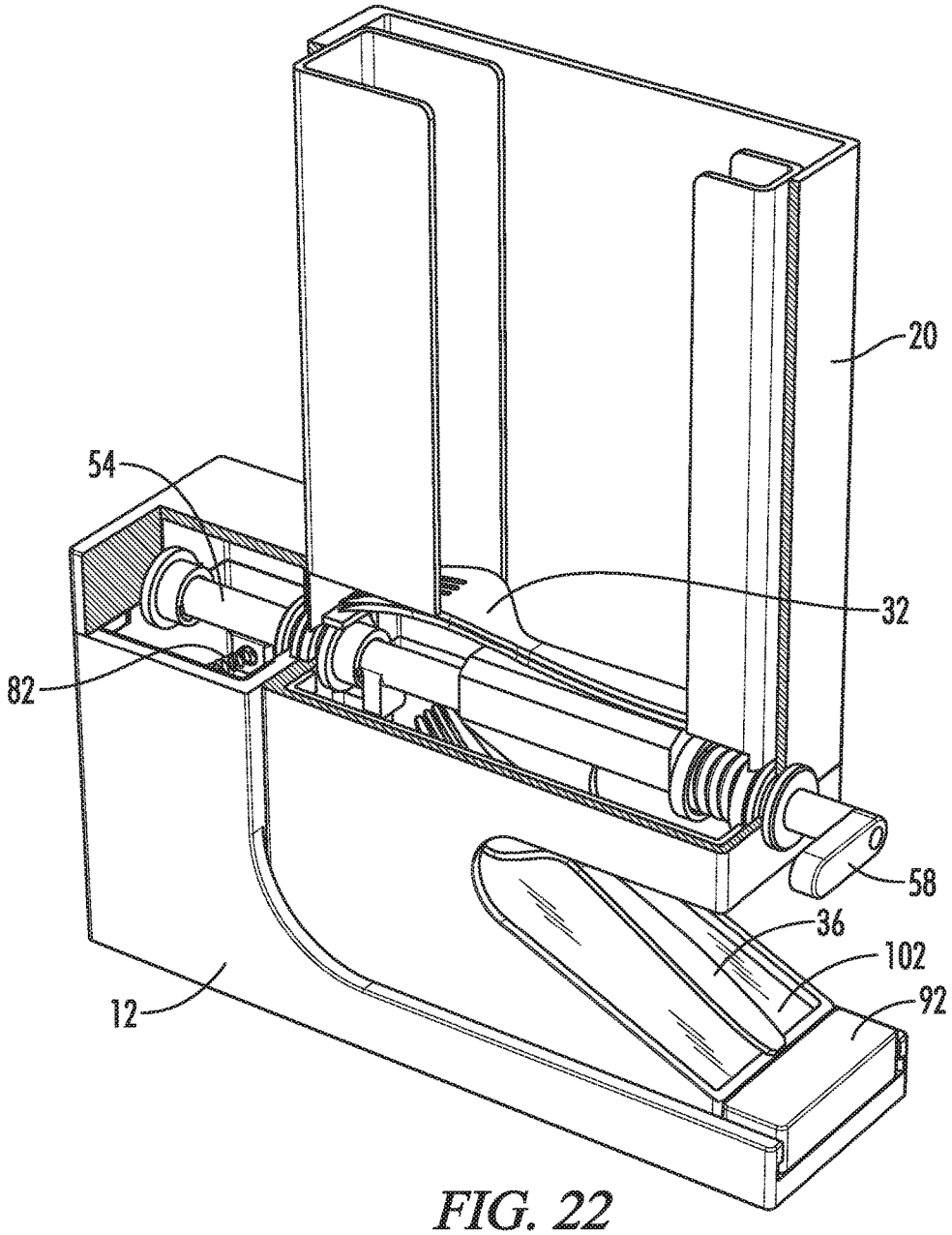
FIG. 22 illustrates a front perspective view of the cutlery dispenser of FIG. 1.

Optionally, the base 12 comprises a base spring 82 comprising a first end 84 attached to the base 12 and a second end 86 attached to the base dispensing mechanism 54, as best seen in FIG. 12 and FIGS. 16-18, to return the actuator 58 to the start position, as seen in FIG. 22.

Optionally, the cartridge 20 comprises a cartridge locked position in which the cartridge is fixed to the base 12 and a cartridge unlocked position in which the cartridge 20 is configured to disengage from the base 12 and in which the cartridge bottom 22 is configured to confront and slide along an upper surface of the base 132. More particularly, the base 12 may comprise a track 88, as best seen in FIGS. 10-12, and the cartridge 12 comprises a flange 90 configured to mate with the track 88 and the cartridge 12 (more particularly flange 90) is configured to slide rearwardly along the track 88 until the cartridge dispensing mechanism 56 is engaged with the base dispensing mechanism 54. This sequence is best illustrated in FIGS. 16-18. Optionally, the base 12 further comprises a removable stop 92 located in front of the track 88, and the user may be required to remove the stop 92 from stop holes 134 before removing the cartridge 20 from the base 12.

Optionally, the cartridge chamber 28 comprises at least one guide column 94, the guide column 94 having a guide column height 96 parallel to the stack height 50.

Figure 19:
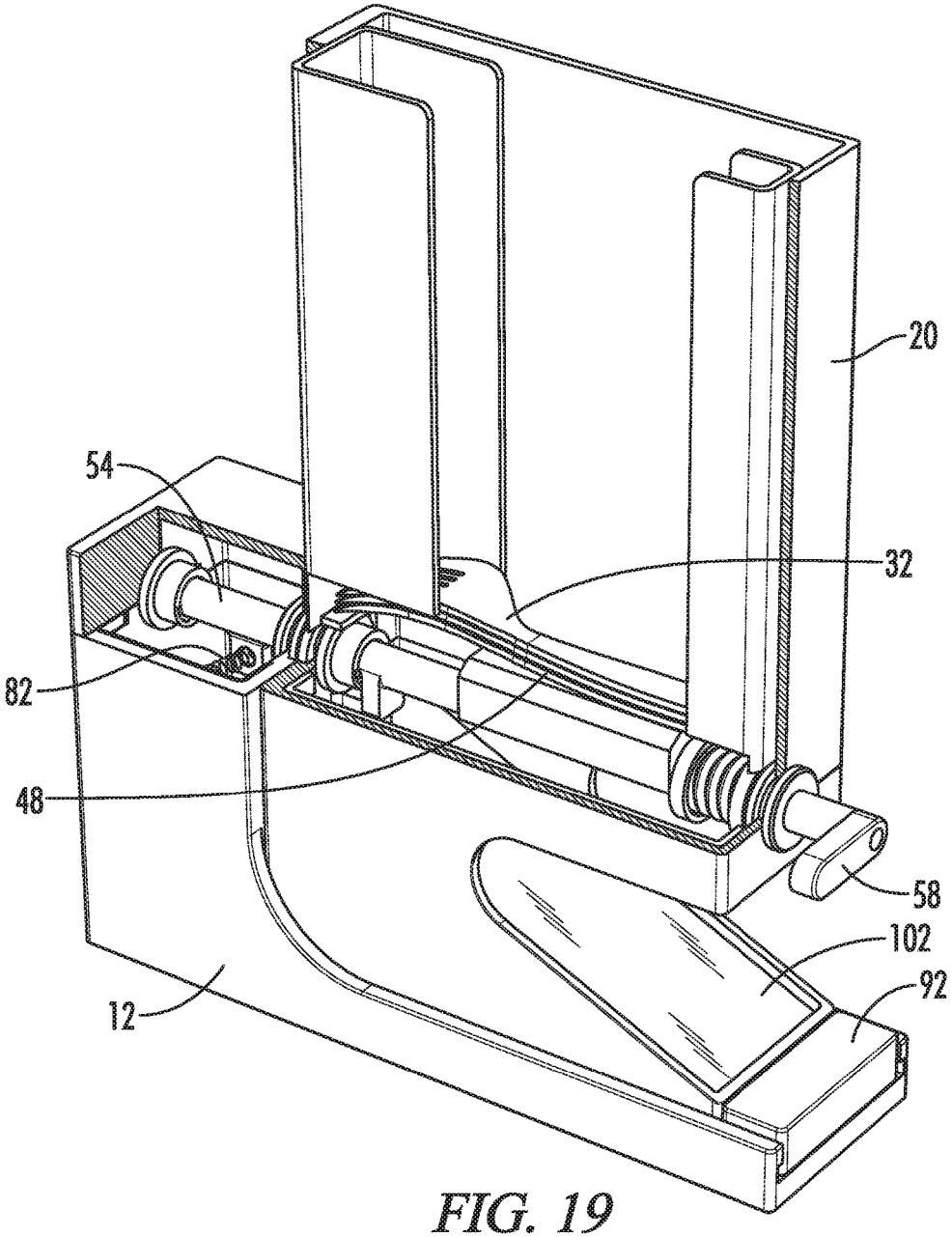
FIG. 19 illustrates a front perspective view of the cutlery dispenser of FIG. 1.
Figure 20:
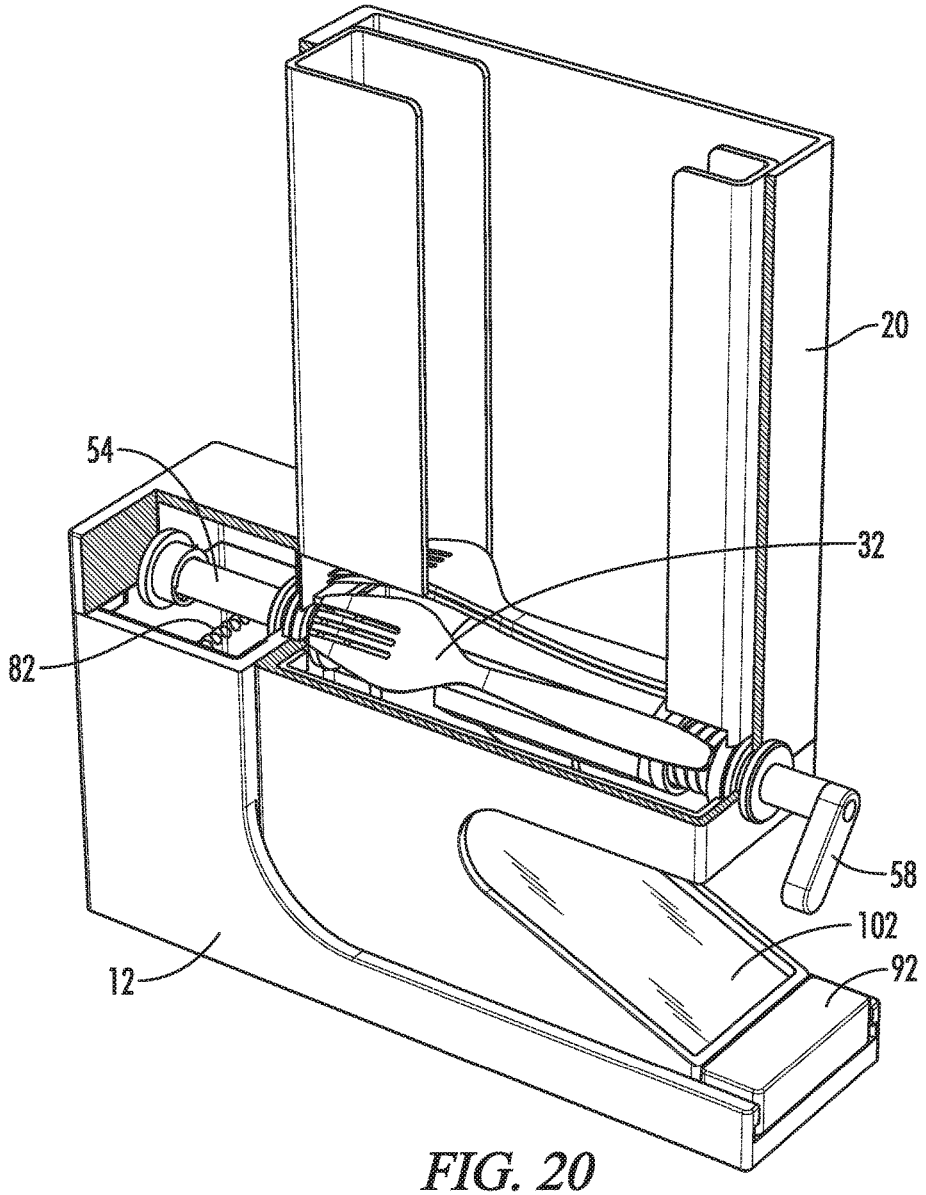
FIG. 20 illustrates a front perspective view of the cutlery dispenser of FIG. 1.
Figure 21:
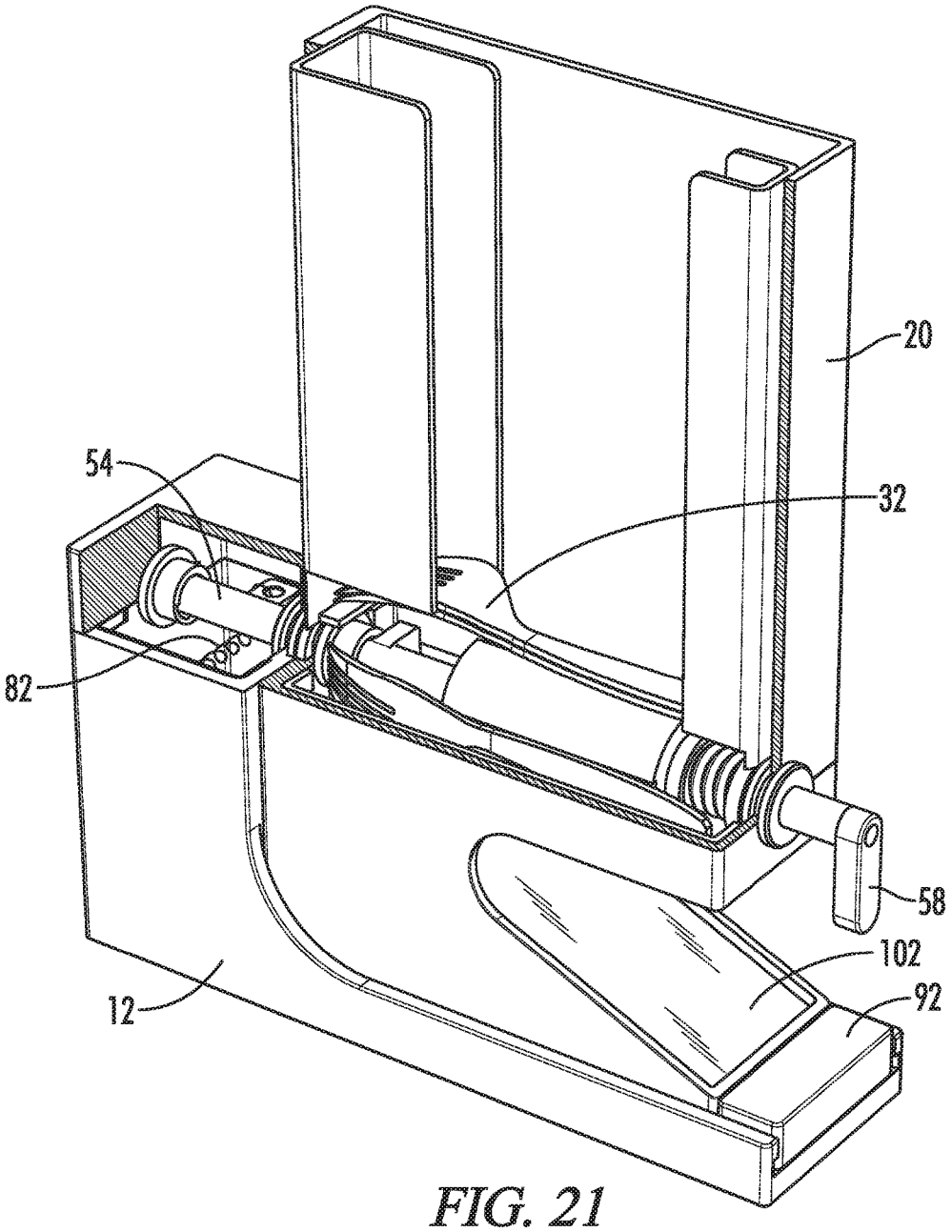
FIG. 21 illustrates a front perspective view of the cutlery dispenser of FIG. 1.

To operate the cutlery dispenser 10, the user may press down on the top left side of the actuator 58, which causes the actuator 58 to move counter-clockwise and the cartridge cam shaft 76 and base cam shaft 74 to move counter-clockwise and eject the bottom piece of cutlery 48 into a chute 100 located to the left of the stack of cutlery pieces 30 and, after exiting the chute 100, down a ramp 102, as shown in FIGS. 19-21. The actuator 58 then may move clockwise back to the start position, as shown in FIG. 22. Optionally, the system dispensing mechanism dispenses the handle 36 of the bottom cutlery piece 48 to a user before the eating portion 32, as shown in FIG. 22, which is accomplished in the exemplary embodiment by having the handle tip 38 be at the front 110 of the cartridge 20 and the eating portion 32 being at the rear 112 of the cartridge 20, as best seen in FIGS. 2, 5, 6, 7, 9 and 15.

Preferably, as previously mentioned, the cartridge 20 is at least partially removable from the base 12. For example, in the illustrated embodiment, the user may remove the stop 92 from stop holes 134 and completely remove the cartridge 20 from the base 12 by sliding the cartridge 20 forwardly. In another embodiment, the cartridge 20 may slide forwardly relative to the base 12 but may not completely disengage from the base 12 during the loading process—e.g., the stop 92 may be non-removable and located a few inches forward relative to the cartridge 20 to allow the cartridge 20 to slide a few inches for loading. Optionally, the cartridge dispensing mechanism 56, in the resting position, comprises a top surface 98, the bottom cutlery piece 48 resting on the top surface 98.

Optionally, the cartridge 20 is generally rectangular in shape and comprises a cartridge left side 104, a cartridge right side 106, a cartridge width 108 extending from the cartridge left side 104 to the cartridge right side 106, a cartridge front side 110, a cartridge rear side 112, a cartridge length 114 extending from the cartridge front side 110 to the cartridge rear side 112, wherein the base 12 is generally rectangular in shape and comprises a base left side 116, a base right side 118, a base width 120 extending from the base left side 116 to the base right side 118, a base front side 122, a base rear side 124, a base length 126 extending from the base front side 122 to the base rear side 124 and further wherein the system dispensing mechanism is configured to move the bottom piece of cutlery 48 into a chute 100 in a direction generally perpendicular to the cutlery piece length 40 and further wherein the cartridge 20 further comprises a ramp 102 configured to receive the piece of cutlery from the chute 100 and move the piece of cutlery forwardly toward a user. Optionally, the ramp 102 further comprises a top 128 and a bottom 130 and further wherein the handle tip 38 of the cutlery is configured to be the first part to reach the ramp bottom 130.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A cutlery dispenser comprising:

a base comprising a base bottom configured to rest on a surface, a base top opposite the base bottom, and a base height extending from the base bottom to the base top;

a cartridge attached to the base and comprising a cartridge bottom, a cartridge top, a cartridge height extending from the cartridge bottom to the cartridge top, and a chamber;

a stack of cutlery pieces located in the cartridge chamber, each cutlery piece having an eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height;

a system dispensing mechanism configured to move between a resting position in which the cutlery stack is stationary within the cartridge chamber to a dispensing position in which the system dispensing mechanism ejects at least a portion of a piece of cutlery out of the cartridge chamber, the system dispensing mechanism comprising a base dispensing mechanism forming a portion of the base and a cartridge dispensing mechanism located in the cartridge chamber, the base dispensing mechanism removably engaged with the cartridge dispensing mechanism; and an actuator configured to move the system dispensing mechanism from the resting position to the dispensing position, wherein the base dispensing mechanism and the cartridge dispensing mechanism are configured to move together in a coupled fashion to eject the portion of the piece of cutlery out of the cartridge chamber, and further wherein the base dispensing mechanism comprises a base cam shaft attached to the base and the cartridge dispensing mechanism comprises a cartridge cam shaft attached to the cartridge, the cartridge cam shaft and the base cam shaft configured to rotate together along an aligned axis of rotation in the same direction in a coupled fashion to eject the portion of the piece of cutlery out of the cartridge chamber.

2. The cutlery dispenser of claim 1 further comprising a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position, wherein engaging the base dispensing mechanism with the cartridge dispensing mechanism is configured to automatically move the dispenser lock from the dispenser locked position to the dispenser unlocked position and further wherein disengaging the base dispensing mechanism from the cartridge dispensing mechanism is configured to automatically move the dispenser lock from the dispenser unlocked position to the dispenser locked position.

3. The dispenser of claim 1 wherein the base comprises a track and the cartridge comprises a flange configured to mate with the track and further wherein the cartridge is configured to slide horizontally along the track.

4. The dispenser of claim 1 wherein the system dispensing mechanism and the actuator pivot in the same direction and generally perpendicular to the cartridge height when the system dispensing mechanism moves from the resting position to the dispensing position.

5. The dispenser of claim 1 wherein, the cartridge dispensing mechanism, in the resting position, comprises a top surface, the bottom cutlery piece resting on the top surface.

6. The dispenser of claim 1, wherein the cartridge further comprises a front end, a rear end opposite the front end, a cartridge length extending from the front end to the rear end, wherein the cutlery pieces are vertically stacked in the cartridge chamber with the eating portions adjacent to the cartridge rear end and the handle tips adjacent to the cartridge front end, wherein the cutlery piece length is generally parallel to the cartridge length, and further wherein the cartridge further comprises a ramp comprising a top end adjacent to the cartridge rear end, and a bottom end adjacent to the cartridge front end, and further wherein, in the dispensing position, the system dispensing mechanism is configured to eject the portion of the piece of cutlery out of the cartridge chamber into a chute located laterally relative to the vertical stack of cutlery pieces and down the ramp so that the handle tip contacts the ramp bottom before the eating portion.

7. The cutlery dispenser of claim 2, wherein the cartridge chamber comprises a wall comprising a wall tab and the cartridge dispensing mechanism further comprises a cartridge dispensing mechanism tab, the wall tab and the cartridge dispensing mechanism tab forming the lock and further wherein the wall tab and the cartridge dispensing mechanism tab are engaged when the dispenser lock is in the dispenser locked position and further wherein the wall tab and the cartridge dispensing mechanism tab are disengaged when the dispenser lock is in the dispenser unlocked position.

8. The cutlery dispenser of claim 7, wherein the cartridge comprises a spring encircling the cartridge cam shaft and configured to press the cartridge dispensing mechanism tab against the wall tab when the cartridge dispensing mechanism is not engaged with the base dispensing mechanism.

9. The dispenser of claim 6 further wherein the ramp is located directly below the eating portions of the cutlery located in the vertical stack.

10. A cutlery dispenser comprising:

a base comprising a base bottom configured to rest on a surface, a base top opposite the base bottom, a base height extending from the base bottom to the base top, and a base upper surface;

a cartridge comprising a cartridge bottom, a cartridge top, a cartridge height extending from the cartridge bottom to the cartridge top, and a chamber;

a stack of cutlery pieces located in the cartridge chamber, each cutlery piece having an eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height;

a cartridge cam shaft located in the cartridge chamber, the cartridge cam shaft comprising a cartridge cam shaft tab;

a wall tab located in the cartridge chamber; and a base cam shaft forming a portion of the base, wherein the cartridge is slideable along the base upper surface between a cartridge locked position in which i) the cartridge cam shaft is engaged with the base cam shaft, ii) the cartridge cam shaft tab is disengaged with the wall tab; and iii) the cartridge cam shaft is permitted to rotate between a resting position in which the cutlery stack is stationary within the cartridge chamber to a dispensing position in which the cartridge cam shaft rotates to eject at least a portion of a piece of cutlery out of the cartridge chamber, and a cartridge unlocked position in which i) the cartridge cam shaft is disengaged from the base cam shaft and ii) the cartridge cam shaft tab is engaged with the wall tab and prevents the cartridge dispensing mechanism from rotating between the resting position and the dispensing position.

11. The cutlery dispenser of claim 10 wherein the base upper surface and the cartridge bottom are generally flat.

12. The cutlery dispenser of claim 10 wherein the base further comprises a track and wherein the cartridge further comprises a flange configured to mate with the track and further wherein the flange is configured to slide along the track in the cartridge unlocked position.

13. The cutlery dispenser of claim 10 wherein the cutlery dispenser further comprises an actuator configured to move the cartridge cam shaft from the resting position to the dispensing position.

14. The cutlery dispenser of claim 10 wherein the cartridge cam shaft and the base cam shaft are configured to rotate together along an aligned axis of rotation in the same direction in a coupled fashion to eject the portion of the piece of cutlery out of the cartridge chamber.

15. The cutlery dispenser of claim 10, wherein the base cam shaft is located directly behind the cartridge cam shaft, wherein the cartridge further comprises a spring encircling the cartridge cam shaft, the spring configured to relax, move rearwardly and urge the cartridge cam shaft tab against the wall tab when the cartridge cam shaft is not engaged with the base cam shaft, and further wherein, engaging the cartridge cam shaft with the base cam shaft is configured to cause the spring to move forwardly and disengage the cartridge cam shaft tab from the wall tab.

16. The cutlery dispenser of claim 12 wherein the track is adjacent to the base upper surface and the flange is adjacent to the cartridge bottom.

17. The cutlery dispenser of claim 12 further comprises a base front, a base back, and a base length extending from the base front to the base back, and wherein the base further comprises two opposing base grooves extending along the base length, the two opposing base grooves forming the track.

18. The cutlery dispenser of claim 12 wherein the cutlery dispenser further comprises a removable stop, the removable stop configured to prevent the flange from sliding along the track length.

19. The cutlery dispenser of claim 17 wherein the base bottom is generally rectangular in shape, wherein the base comprises a first side wall comprising one of the base grooves and the base comprises a second side wall opposite the first side wall and comprising the other base groove.

20. The cutlery dispenser of claim 19 wherein the first side wall and the second side wall border the base upper surface.

21. The cutlery dispenser of claim 14 wherein the base further comprises a housing comprising the base cam shaft and further wherein the base further comprises a spring attaching the base cam shaft to the base housing, the spring configured to rotate the cartridge cam shaft from the dispensing position to the resting position.

22. A cutlery dispenser comprising:

a base comprising a base bottom configured to rest on a surface, a base top opposite the base bottom, a base height extending from the base bottom to the base top, a base front end, a base rear end, a base length extending from the base front end to the base rear end, and a generally flat base upper surface extending generally parallel to the base length;

a cartridge comprising a cartridge bottom, a cartridge top, a cartridge height extending from the cartridge bottom to the cartridge top, and a chamber, the cartridge horizontally slideable along the base upper surface generally parallel to the base length;

cutlery pieces vertically stacked in the cartridge chamber, each cutlery piece having an eating portion comprising an eating portion tip, a handle comprising a handle tip and a cutlery piece length extending from the eating portion tip to the handle tip, the cutlery piece length generally perpendicular to the cartridge height, the stack of cutlery pieces comprising a top comprising a top cutlery piece, a bottom comprising a bottom cutlery piece and a stack height extending from the top cutlery piece to the bottom cutlery piece and generally parallel to the cartridge height; and a system dispensing mechanism configured to move between a resting position in which the cutlery stack is stationary within the cartridge chamber to a dispensing position in which the system dispensing mechanism ejects at least a portion of a piece of cutlery out of the cartridge chamber, wherein the cartridge is configured to slide horizontally relative to the base from a first position to a second position, wherein the cartridge comprises a front end, a rear end opposite the front end, a cartridge length extending from the front end to the rear end, wherein the cutlery pieces are stacked in the cartridge chamber with the eating portions adjacent to the cartridge rear end and the handle tips adjacent to the cartridge front end, wherein the cutlery piece length is generally parallel to the cartridge length, wherein the cartridge comprises a ramp comprising a top end adjacent to the cartridge rear end, and a bottom end adjacent to the cartridge front end, and further wherein, in the dispensing position, the system dispensing mechanism is configured to eject the portion of the piece of cutlery out of the cartridge chamber into a chute located laterally relative to the vertical stack of cutlery pieces and down the ramp so that the handle tip contacts the ramp bottom before the eating portion, wherein the base comprises two sidewalls comprising longitudinal grooves, the longitudinal grooves and two sidewalls located on opposite of the base and bordering the base upper surface and extending generally parallel to the base length, and further wherein the cartridge comprises a flange located adjacent to the cartridge bottom and configured to engage the longitudinal grooves and slide along the longitudinal grooves as the cartridge horizontally slides along the base upper surface generally parallel to the base length, and further wherein the base is generally L-shaped and comprises a horizontal extension comprising the base upper surface and the longitudinal grooves and a vertical extension extending generally perpendicular to the horizontal extension and further wherein the cartridge is configured to slide horizontally along the longitudinal grooves and base upper surface until the cartridge rear end contacts the base vertical extension, and further wherein, when the cartridge rear end contacts the base vertical extension, the ramp is located directly above the base upper surface.

23. The cutlery dispenser of claim 22 wherein the ramp is located directly below the eating portions of the cutlery located in the vertical stack.

24. The cutlery dispenser of claim 22 further comprising a dispenser lock, the dispenser lock having a dispenser locked position preventing the system dispensing mechanism from moving between the resting position and the dispensing position and a dispenser unlocked position in which the system dispensing mechanism is permitted to move between the resting position and the dispensing position.

* * * * *